United States Patent [19]

Pitkanen

[11] 4,227,690

[45] Oct. 14, 1980

[54] REACTION GAME APPARATUS

[76] Inventor: Alan R. Pitkanen, 3120 Ocean Dr., Manhattan Beach, Calif. 90266

[21] Appl. No.: 959,770

[22] Filed: Nov. 13, 1978

[51] Int. Cl.[3] ..... A63F 7/02; A63F 9/04

[52] U.S. Cl. ..... 273/1 R; 273/143 A

[58] Field of Search ..... 273/1 R, 1 E, 1 M, 128 A, 273/129 E, 143 A, 145 B

[56] References Cited

U.S. PATENT DOCUMENTS

| | | | |
|---|---|---|---|
| 1,536,510 | 5/1925 | McGarth et al. | 273/143 A |
| 3,339,921 | 5/1967 | Glass et al. | 273/1 R |
| 3,784,197 | 1/1974 | Massicotte | 273/1 X |
| 3,989,243 | 11/1976 | Breslow | 273/1 R |

FOREIGN PATENT DOCUMENTS

| | | | |
|---|---|---|---|
| 61809 | 4/1892 | Fed. Rep. of Germany | 273/143 A |
| 76590 | 8/1894 | Fed. Rep. of Germany | 273/143 A |

*Primary Examiner*—Paul E. Shapiro

*Attorney, Agent, or Firm*—Keith D. Beecher

[57] ABSTRACT

A game apparatus in which die is provided with two stub axles which project out from opposite faces thereof. The game includes a base which has a channel extending thereacross equipped with spaced and parallel ramps on the sides thereof which are inclined downwardly from the ends of the channel towards the center of the base. A vertical slot is provided at the center extending downwardly from the ramps. The die is allowed to roll down one pair of ramps from one end of the channel with the axles of the die engaging the ramps. When the die reaches the center of the channel, its axles fall down the vertical slots, and the die drops to the bottom of the channel coming to rest with one of its faces exposed. Sets of flippers are pivotally mounted along selected sides of the base for individual movement by different players from outer positions to inner positions. When any flipper is in its inner position, its distal end covers the exposed face of the die. The ends of each of the flippers of each set have indicia thereon corresponding to the indicia on the die. The object of the game is for a player to be the first to cover the exposed face of the die, after the die has come to rest at the center of the channel, with the flipper of his set which has the correct indicia with respect to the indicia on the exposed face of the die.

4 Claims, 4 Drawing Figures

REACTION GAME APPARATUS

BACKGROUND

The game apparatus of the invention may constitute an implementation of the well-known game of rock-/paper/scissors. For such an implementation, indicia representing a rock, a piece of paper and a pair of scissors are formed on three sides of the die, and on the ends of the flippers of each set. Then, when the die comes to rest at the bottom of the channel, the first player to cover the exposed face of the die with a flipper having the proper indicia scores a point. The correct order is paper over rock (because paper covers rock); scissors over paper (because scissors cut paper); and rock over scissors (because rock crushes scissors). A fourth face of the die may have a symbol representing dynamite, and if the symbol is exposed when the die comes to rest at the center of the channel, and if any player covers that symbol with one of his flippers, he loses all his points (because the dynamite explodes).

A particular feature of the game apparatus of the invention is the indicia bearing die which, as stated, acts as a play director. As explained above, the die is rolled down an inclined ramp on its axles to a central position on the base at which the die comes to rest with one of its faces exposed. Each player must then react quickly and flip the proper flipper over, and to be the first player to cover the exposed face of the die with the proper flipper.

It is to be understood, of course, that the game apparatus of the invention is not limited to the implementaton of the rock/paper/scissors games described above, but can be used to implement a variety of other games.

DETAILED DESCRIPTION OF THE ILLUSTRATED EMBODIMENT

Figure 2:
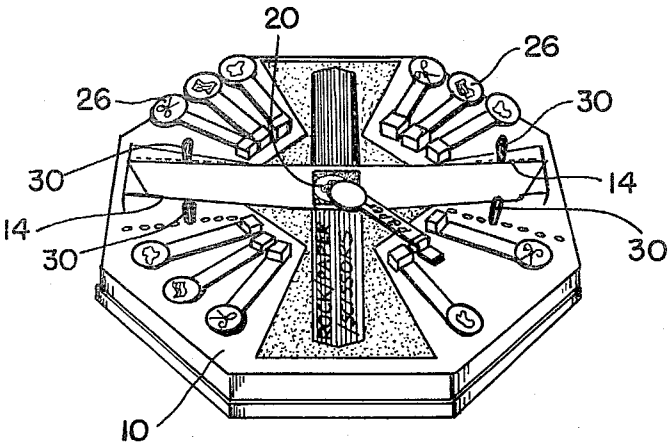
FIG. 2 is a second perspective representation of the game apparatus, showing the die at rest at the center of the channel, and with its exposed face covered with the distal end of one of the flippers of the game.
Figure 4:
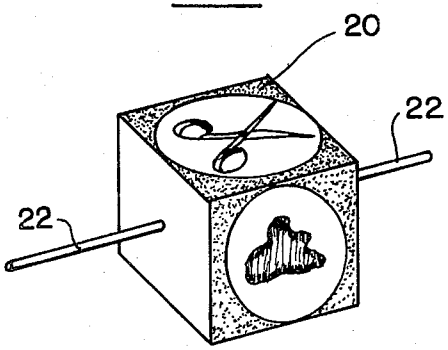
FIG. 4 is a perspective representation of the die used as a play director in the game apparatus.
Figure 1:
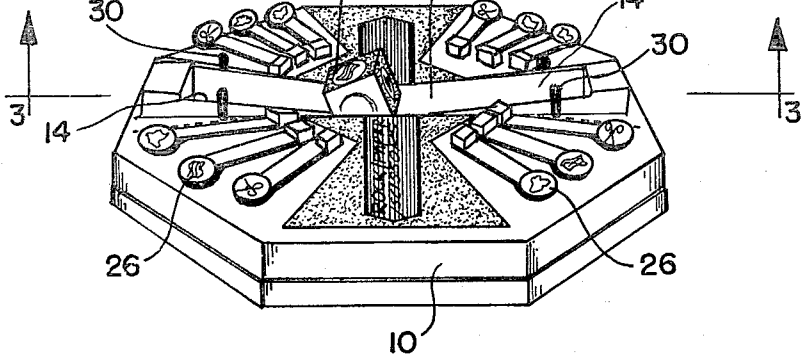
FIG. 1 is a perspective representation of the game apparatus of the invention in one of its embodiments, and showing the die rollng down the inclined ramp.
Figure 3:
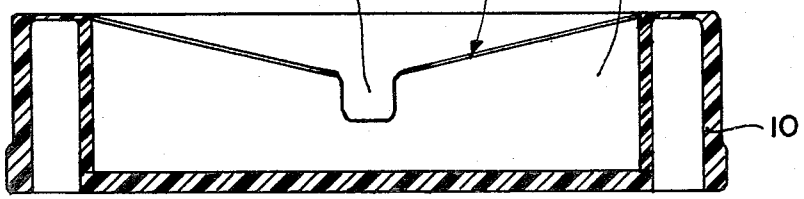
FIG. 3 is a cross-section of the appratus of FIG. 1, taken essentially along the line 3—3 of FIG. 1.

The game apparatus shown in FIGS. 1, 2 and 3 comprises a base 10 which, in the illustrated embodiment has an octagonal shape. A central channel 12 extends across the base from one side to the other. Ramps, such as ramp 14 are formed on opposite sides of the channel, the ramps being inclined from the ends of the channel inwardly and downwardly toward the center. Vertical slots, such as slot 16 are provided at the center of the ramps.

A cubical die 20 is provided with a pair of stub axles 22. The stub axles are coaxial with one another and extend outwardly from opposite faces of the die.

In playing the game, the die 20 is rolled down the channel 12 from either end with its axles 22 rolling along the ramps 14. The die rolls down from either end toward the center, as shown in FIG. 1. When the die reaches the center of the channel, its axles 22 are received in the vertical slots 16, and the die drops to the position shown in FIG. 2, with one of its faces exposed .

As explained above, three of the faces of the die may contain indicia representing a rock, scissors and paper. As also explained, the fourth face of the die may contain indicia representing dynamite.

A plurality of sets of flippers 26 are provided around the board, in the positions shown in FIGS. 1 and 2. Each set, for example, may contain three flippers, and each set may be disposed adjacent to different selected sides of the base corresponding to the positions of the individual players.

In playing the game, as soon as the die 20 comes to rest at the center of the channel, in the position shown in FIG. 2, a player reacts quickly and flips the proper flipper over so that its distal end will cover the exposed face of the die, as shown in FIG. 2. For this purpose, each flipper is pivotally mounted on the base, and moves in a vertical arc from its outer position of FIG. 1 to its inner position, as shown by one of the flippers in FIG. 2.

The correct flipper must be operated. For example, if the exposed face of the die 20 is a stone, the flipper representing paper must be actuated, as shown in FIG. 2, in order for the player to score. The flippers are constructed so that the distal ends thereof from each playing position stack as they arrive in position over the exposed face of the die, such that the order of arrival may be determined for second, third, and fourth, etc., place scoring determination; that is, the end of the second flipper to arrive lands on top of the end of the first flipper to arrive, and so on. This is true for the flippers from any particular player station, or from different player stations.

Individual scores may be kept by pegs 30, which may be moved in holes in the base adjacent to each player position.

The invention provides, therefore, a game apparatus by which play is directed by a particular type of die which has stub axles, and which rolls down an inclined ramp to a play directing position.

As stated above, although a particular embodiment of the game appartus has been shown and described, modifications may be made. It is intended in the claims to cover the modifications which come within the spirit and scope of the invention.

What is claimed is:

1. A game apparatus including: a base having a channel therein with inclined ramp means formed at the sides of the channel, the channel extending across the base from opposite sides thereof, and the inclined ramp means forming two ramps respectively extending inwardly and downwardly from the opposite sides of the base to the center thereof; a die having a plurality of faces; and a pair of stub axles extending coaxially from the opposite sides of the die to be received on the inclined ramp means so as to permit the die to roll down the ramp means to a position in which the die comes to rest with one of its faces in an exposed position, said base having vertical slots formed in the respective sides of the channel at the center of the base to receive the axles of the die so as to permit the die to drop downwardly to a position of rest at the center of the base with its uppermost face in said exposed position.

2. A game apparatus including: a base having a channel therein with inclined ramp means formed at the sides of the channel; a die having a plurality of faces;

and a pair of stub axles extending coaxially from the opposite sides of the die to be received on the inclined ramp means so as to permit the die to roll down the ramp means to a position in which the die comes to rest with one of its faces in an exposed position, and which includes a plurality of flippers pivotally mounted along selected sides of the base for arcuate movement perpendiculr to the base of each of said flippers from an outer position to an inner position in which the distal end thereof covers the exposed face of the die.

3. The game apparatus defined in claim 2, in which the board has a polygonal shape.

4. The game apparatus defined in claim 2, in which the distal ends of the flippers stack over one another at the inner position so that the order of arrival of the flippers can be determined.

* * * * *